US006994041B2

(12) United States Patent
Manson

(10) Patent No.: US 6,994,041 B2
(45) Date of Patent: Feb. 7, 2006

(54) EMBROIDERY SEWING MACHINE HOOP GUARD

(76) Inventor: Adrianne L. Manson, 10594 Cambrooke Cove, Collierville, TN (US) 38017

( * ) Notice: Subject to any disclaimer, the term of this patent is extended or adjusted under 35 U.S.C. 154(b) by 0 days.

(21) Appl. No.: 10/984,738

(22) Filed: Nov. 10, 2004

(65) Prior Publication Data

US 2005/0120931 A1 Jun. 9, 2005

Related U.S. Application Data

(60) Provisional application No. 60/527,007, filed on Dec. 5, 2003.

(51) Int. Cl.
*D05B 83/00* (2006.01)

(52) U.S. Cl. ..... 112/261; 112/1

(58) Field of Classification Search ..... 112/103, 112/261, 475; 81/64; 301/37.103, 37.42; 118/504; 2/15; 38/102.2
See application file for complete search history.

(56) References Cited

U.S. PATENT DOCUMENTS 519,258 A * 5/1894 Hill ..... 38/102.2
1,944,690 A * 1/1934 Karle ..... 112/121
2,081,666 A 5/1937 Gunn
5,070,810 A 12/1991 Dieter
5,555,828 A 9/1996 Rowley
5,676,074 A * 10/1997 Bengal ..... 112/103
5,785,389 A * 7/1998 Bradford ..... 301/37.42
5,915,315 A 6/1999 Bentz
6,101,903 A * 8/2000 Negley et al. ..... 81/64
6,109,194 A 8/2000 Farb
6,834,568 B2 * 12/2004 Khubani ..... 81/64

FOREIGN PATENT DOCUMENTS

FR 2707908 * 1/1995

* cited by examiner

*Primary Examiner*—Ismael Izaguirre
(74) *Attorney, Agent, or Firm*—Richard C. Litman

(57) ABSTRACT

An embroidery sewing machine hoop guard includes a strap held by a handle portion having a grip, a strap attachment wall for attachment of one end of the strap, and a buckle for receiving the other end, allowing the strap to be held on edge in a generally circular position. The strap adjusts to fit within a hoop while allowing adhesive spraying of a flat area of clothing material to be embroidered, protecting from overspray of adhesive, thus avoiding periodic cleaning of the hoop. The hoop guard may be held on any surface within which a spray material or coating is applied to the surface, by gripping with one hand while a spray device is operated by the other hand to spray an area of the surface within the boundary formed by the strap and handle portion. This prevents overspray beyond that area, protecting other elements or surfaces.

19 Claims, 8 Drawing Sheets

EMBROIDERY SEWING MACHINE HOOP GUARD

CROSS-REFERENCE TO RELATED APPLICATION

This application claims the benefit of U.S. Provisional Application Ser. No. 60/527,007, filed Dec. 5, 2003.

BACKGROUND OF THE INVENTION

1. Field of the Invention

The present invention relates to embroidery sewing machines. More particularly, the present invention relates to overspray guards particularly useful in prevention of adhesive overspray for a piece of cloth material stretched and held in place by an embroidery hoop from reaching the hoop.

2. Description of the Related Art

The use of hoops to stretch and hold cloth material of a garment for embroidery by a machine is widely employed. In a typical application, the cloth material is covered by a backing or substrate material attached to the cloth material by adhesive. The backing material is generally of relatively stiff paper or cloth and serves to provide support for the embroidered portion of the cloth material to provide an improved embroidery appearance. The backing may also be provided with a pattern for use during the embroider process. Once the embroidery is completed, the excess backing is cut away from the embroidery as required.

During the application of adhesive to the cloth material of the garment, overspray tends to collect on the hoops. This requires periodic cleaning of the hoops resulting in production time loss. It would be desirable to provide a masking device or guard which fits around the embroidery area to which adhesive is applied, but is smaller in size than the hoop so as to prevent overspray adhesive from reaching the hoop.

Thus, an embroidery sewing machine hoop guard solving the aforementioned problems is desired.

SUMMARY OF THE INVENTION

The embroidery sewing machine hoop guard of the present invention includes an adjustable length strap held by a handle portion having a grip, a strap attachment wall for attachment of one end of the strap, and a buckle for receiving the other end of the strap, allowing the strap to be held on edge in a generally circular position. The hoop guard may be held on a surface within which a spray material may be applied to the surface to prevent overspray beyond the area surrounded by the circular strap and handle portion. The handle portion has a hand grip for placing and holding the hoop guard on a surface to be sprayed with one hand while the spray device is operated by the other hand to accurately spray an area of the surface within the boundary formed by the strap and handle portion.

The hoop guard is primarily intended to be used in conjunction with an embroidery machine where clothing material is stretched to form a flat area by a hoop system, the clothing material being then sprayed with an adhesive for application of backing material to the clothing material prior to the embroidery step. The hoop guard allows for accurate spraying of adhesive within the circled strap while avoiding overspray reaching the hoop surrounding the stretched clothing material, thus acting as a masking device. This eliminates down time during the production of embroidered clothing items such as shirts and hats.

The hoop guard has replaceable and interchangeable straps of differing lengths to fit within a particular hoop while providing adhesive coverage of the area of the embroidery. The strap may also be arranged in an elongated shape to fit within a generally rectangular hoop. Although the hoop guard is intended for use during the embroidery process, it may have general use as an overspray guard or masking device to confine sprayed material such as paints or other coatings to a desired location on a surface, avoiding any overspray reaching adjacent elements or surfaces.

It is an aspect of the invention to provide improved elements and arrangements thereof for the purposes described which is inexpensive, dependable and fully effective in accomplishing its intended purposes.

These and other aspect of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an embroidery sewing machine hoop guard which includes a strap held by a handle portion having a grip, a strap attachment wall for attachment of one end of the strap, and a buckle for receiving the other end, allowing the strap to be held on edge in a generally circular position. The strap adjusts to fit within a hoop while allowing adhesive spraying of a flat area of clothing material to be embroidered, protecting from overspray of adhesive, thus avoiding periodic cleaning of adhesive buildup from the hoop.

Figure 1A:
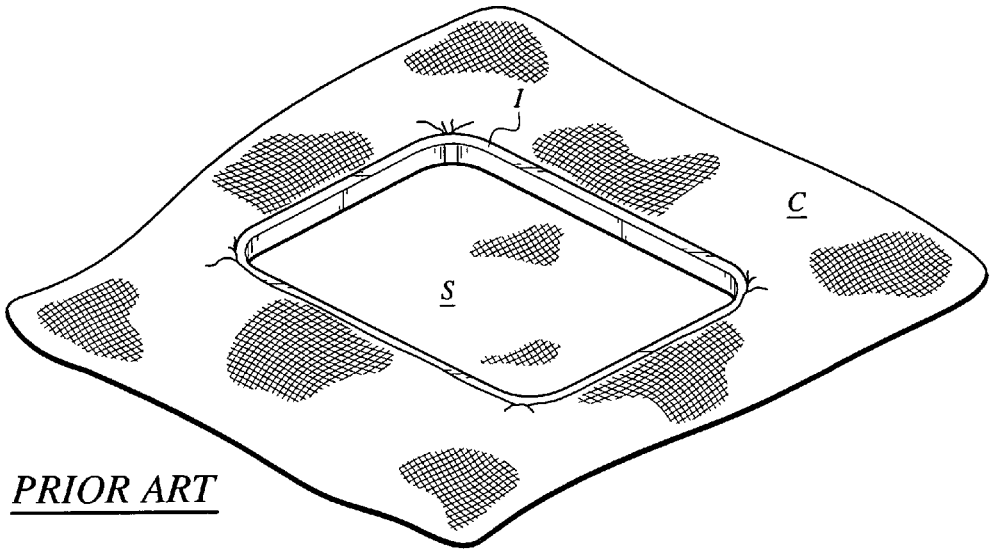
FIG. 1A is an environmental, perspective view of a prior art embroidery sewing machine hoop as applied to a clothing material useful with the present invention.

Referring to FIG. 1A, there is shown an environmental perspective view of a machine embroidery inner hoop I surrounding a stretched, flat portion S of clothing material C in a conventional manner. This type of hoop and embroidery sewing machine is well known as described and illustrated as prior art in U.S. Pat. No. 6,109,194 to Farb, hereby incorporated by reference. In such machines the hooped clothing material is held between inner hoop I and an outer hoop (not shown) which rests on or is part of a base which is programmed to move relative to the arm of machine M and embroidery needle N (see FIG. 1C) so as to form an embroidered design D on the cloth portion S.

Figure 1B:
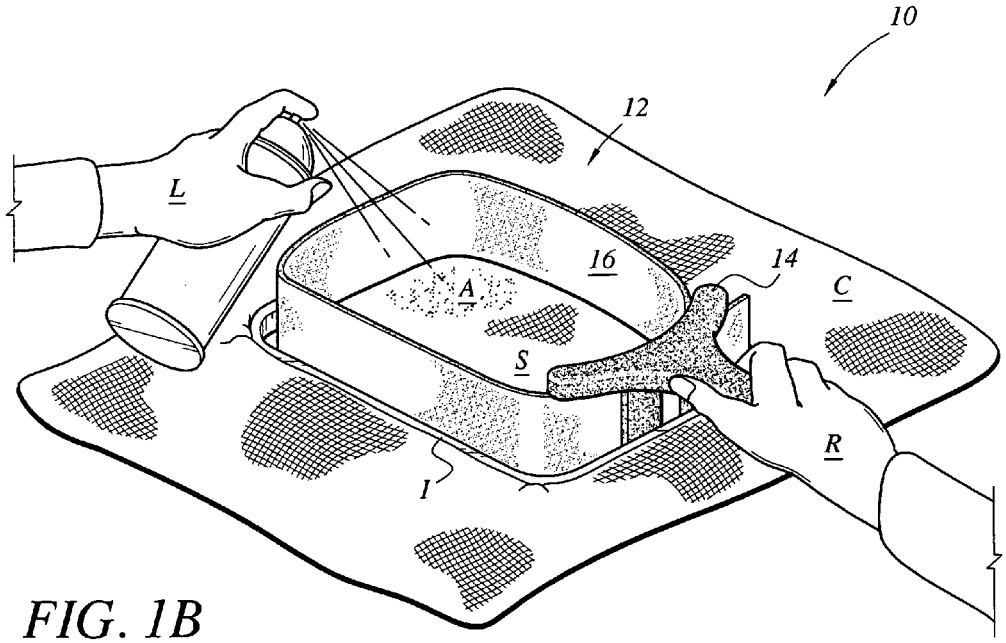
FIG. 1B is an environmental, perspective view of the inventive hoop guard as used in the adhesive spraying process for the hoop and clothing material of FIG. 1.

Referring particularly to FIG. 1B there is shown a hoop guard system 10 of the present invention where the inventive embroidery hoop guard 12 is held on the surface of stretched portion S of clothing material C and within inner hoop I. Hoop guard 12 includes a handle portion 14 which supports guard strap 16 in a generally circular or rectangular shape so as to fit within inner hoop I. The belt may be of a flexible plastic material which may be formed into the desired shape. During the embroidery process, an adhesive A is sprayed on stretched material S to receive a backing of paper or cloth. Without the protection of a guard or other masking technique, the adhesive spray may accidentally be directed to the inner hoop I or overspray may carry over to the hoop during the spraying operation. During production of embroidered cloth, the hoop I must be periodically cleaned of the buildup of such adhesive overspray, resulting in lost production time and use of solvents.

Figure 1C:
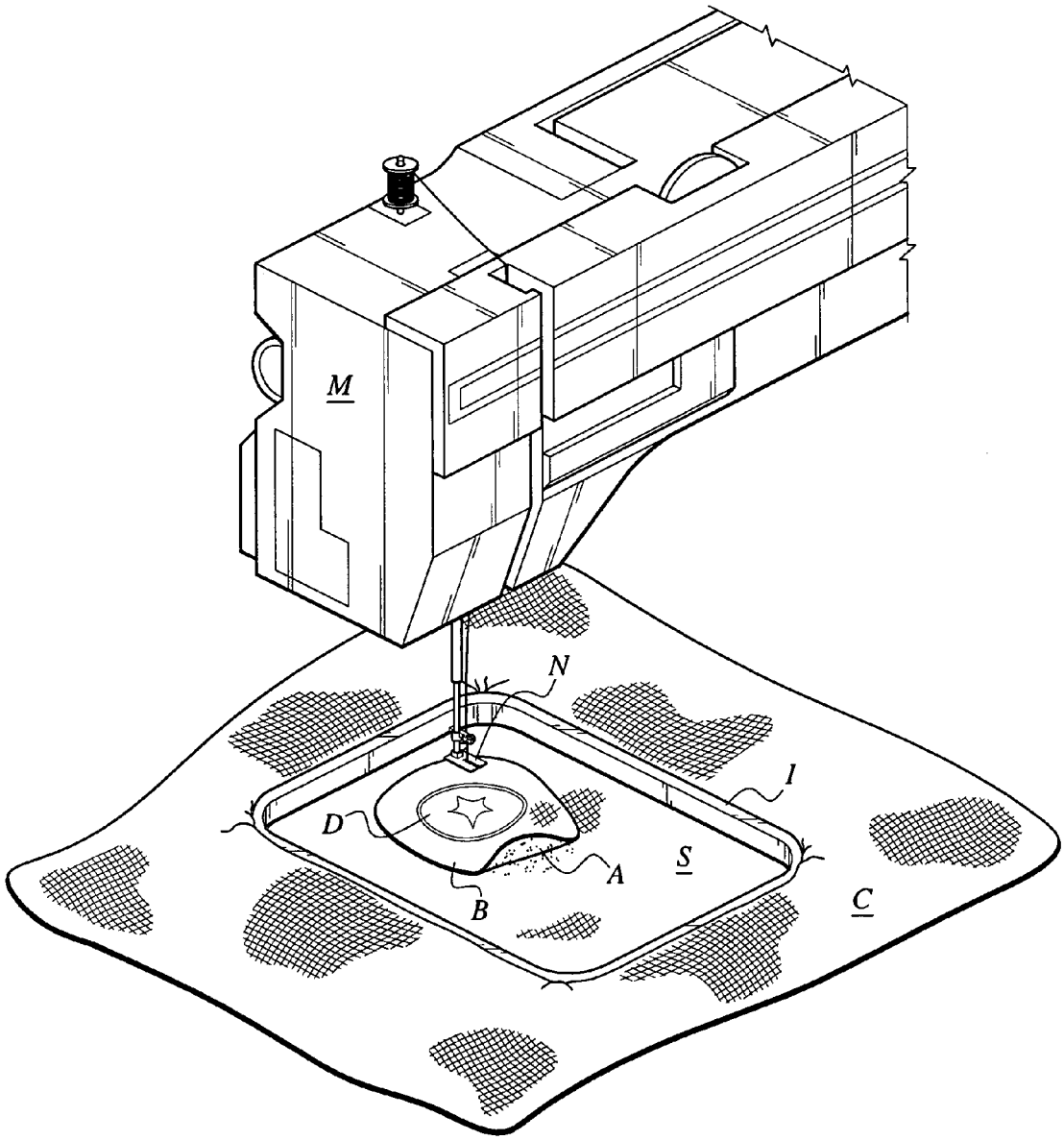
FIG. 1C is an environmental, perspective view of an embroidery machine with the hoop and clothing material as in FIG. 1B showing backing material applied to the adhesive coated clothing material within the hoop in position for embroidery of the clothing material.

As seen in FIG. 1B, during the adhesive spraying operation, the handle portion 14 of guard 12 may be held in the right hand R while the left hand L operates an adhesive spraying device such as a spray can, directing the adhesive A onto the surface of stretched material S. The hoop guard 12 as shown protects the inner hoop I from overspray of adhesive. The hoop guard 12 is then lifted from the stretched material S and set aside. As seen in FIG. 1C, backing B is then placed on stretched material S to which it adheres by adhesive A. An embroidery design D is sewn through the backing and material S by operation of machine. M and needle assembly N in a conventional manner. The backing may be of a patch size as illustrated, or a large sheet which adheres to the material S only in the area within inner hoop I. Once the embroidery is complete, the clothing material is removed from hoop I by loosening the outer hoop (not shown) and excess backing material cut away from the finished embroidery.

Figure 2:
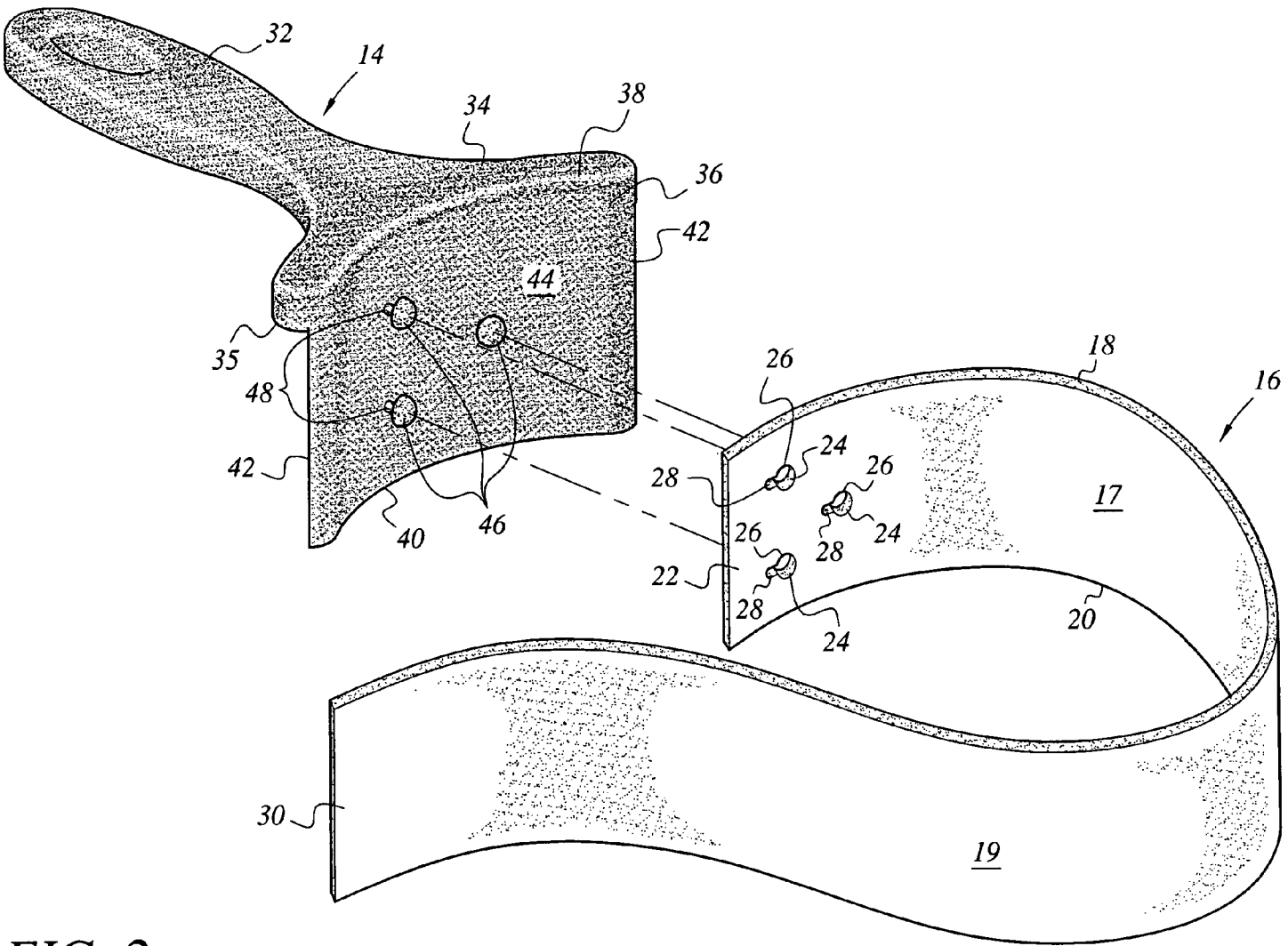
FIG. 2 is an exploded view of the handle portion and adjustable strap of the present invention.
Figure 3:
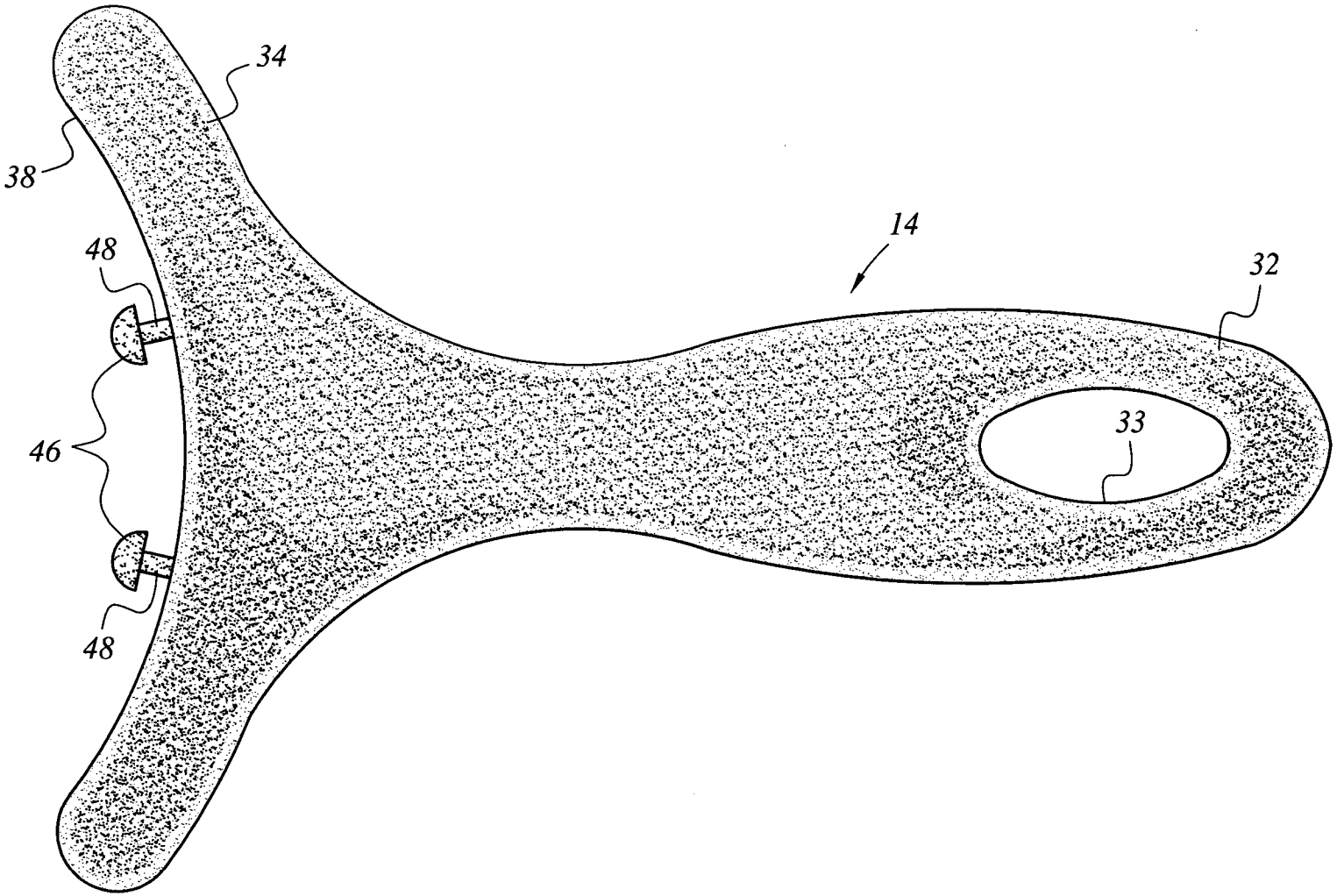
FIG. 3 is a plan view of the handle portion of FIG. 2.

Referring to FIGS. 2 and 3, there is shown an exploded view of the inventive hoop guard and a plan view of the hoop guard handle portion, respectively. Hoop guard strap 16 is an elongated web having an inner surface or side 17, an upper edge 18, an outer surface or side 19, and a lower edge 20 and has opposed attachment end portion 22 and buckle end portion 30. The attachment end portion 22 has three mushroom connector head receivers 24 in a triangular pattern with two of the receivers 24 vertically aligned. Each mushroom connector head 24 has a head receiver 26 and a stem receiver 28.

Handle portion 14 has a grip portion 32 including a hanging opening 33 at its outer end for storage on a hook or other holder. Handle portion 14 also has a strap support portion 35 located at its inner end having a vertically oriented, arcuate strap support wall 36 extending downward therefrom at strap support horizontal upper edge 38 and ending in horizontal lower edge 40. Arcuate strap support wall 36 depends downward from strap support portion 35 between vertical ends 42, the inner side 44 forming a portion of the enclosure formed by strap 16. Strap support portion 34 has a flat underside 35 extending outward from strap support wall 36 toward grip 32. Strap support wall 36 has an inner side 44 having mushroom connectors 46 on stems 48 mounted thereon in a triangle corresponding to the mushroom connector receivers 24 of strap attachment end portion 22 such that strap 16 extends outward in the same plane as the concave, arcuate strap support wall 36.

Figure 4:
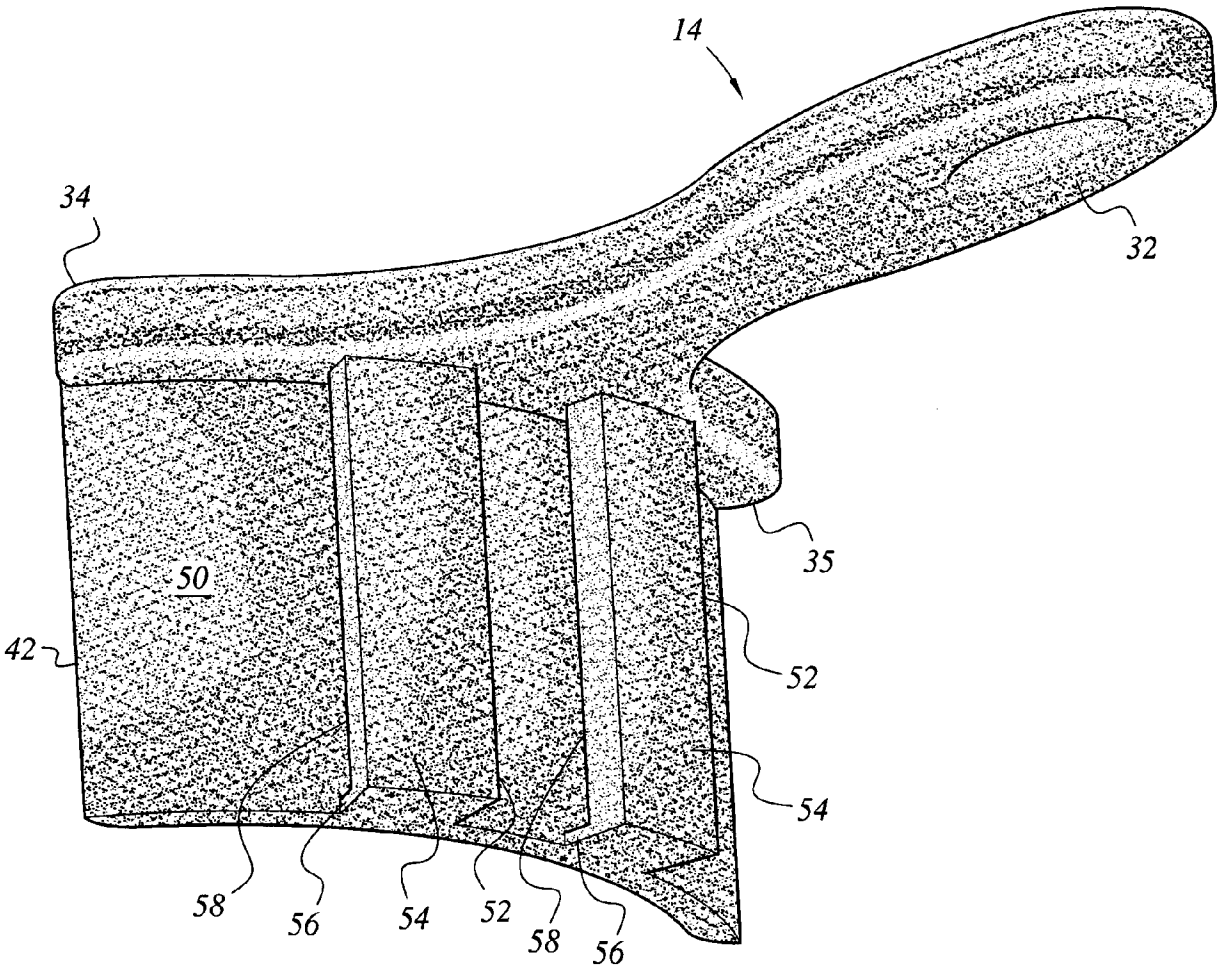
FIG. 4 is a lower rear perspective view of the handle portion of FIG. 2 showing the strap receiving buckle.
Figure 5:
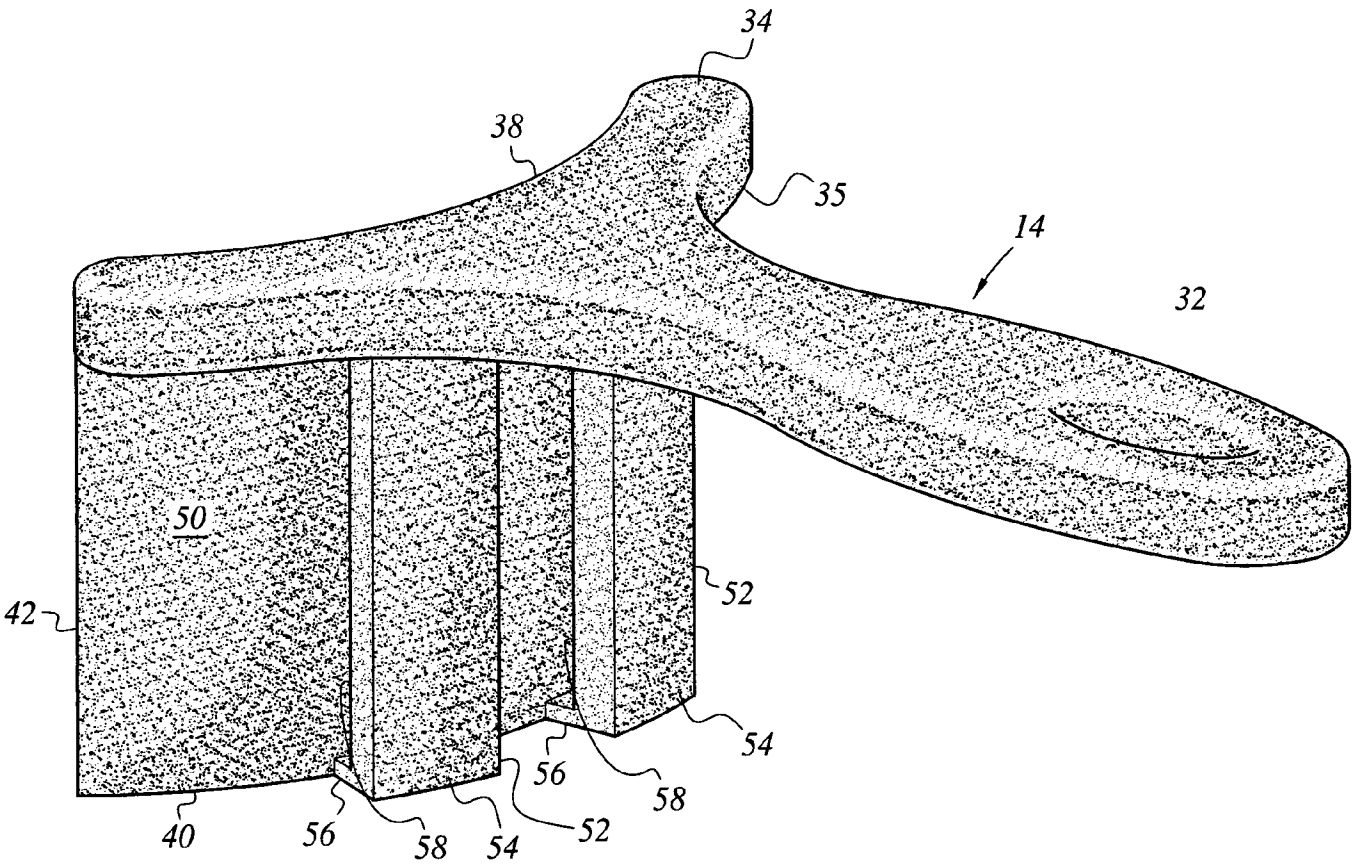
FIG. 5 is an upper rear perspective view of the handle portion of FIG. 2.

Referring to FIGS. 4 and 5, there are shown respective lower and upper rear perspective views of hoop guard handle 14. Arcuate strap support wall 36 (see FIG. 2) has a convex outer side 50 conforming to concave strap support wall 36 from which a pair of spaced strap buckle end receivers 52 extend. End receivers 52 have buckle uprights 54 spaced from outer side 50 and include lower spacers 56 at strap support wall lower edge 40. Buckle uprights 54 extend vertically to the underside 35 of strap support portion 34, thereby defining strap receiving slots 58. Uprights 54 are spaced from outer side 50 a distance such as to receive the buckle end portion 30 of hoop guard strap 16 which is adjustably held in place by friction between the strap 16, the uprights 54 and the outer side 50 of wall 36. It is noted that uprights 54 are disposed at an angle therebetween due to the curvature of wall 36, tending to increase the frictional force retaining the strap 16 in the frictional buckle formed thereby. Strap receiving buckle uprights 54 are preferably equally spaced on opposite sides of grip portion 32.

Figure 6:
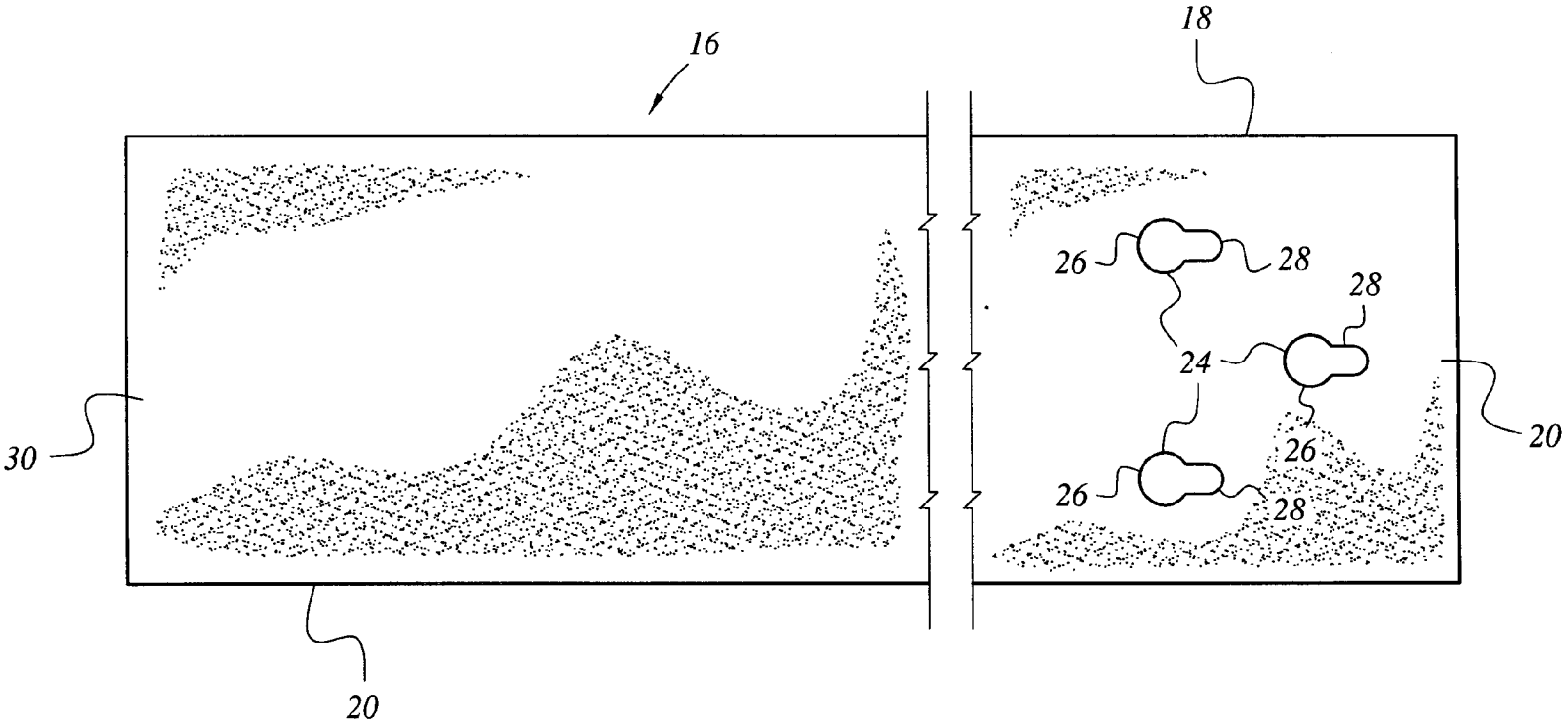
FIG. 6 is an elevation view of the adjustable, interchangeable strap of FIG. 2.
Figure 7:
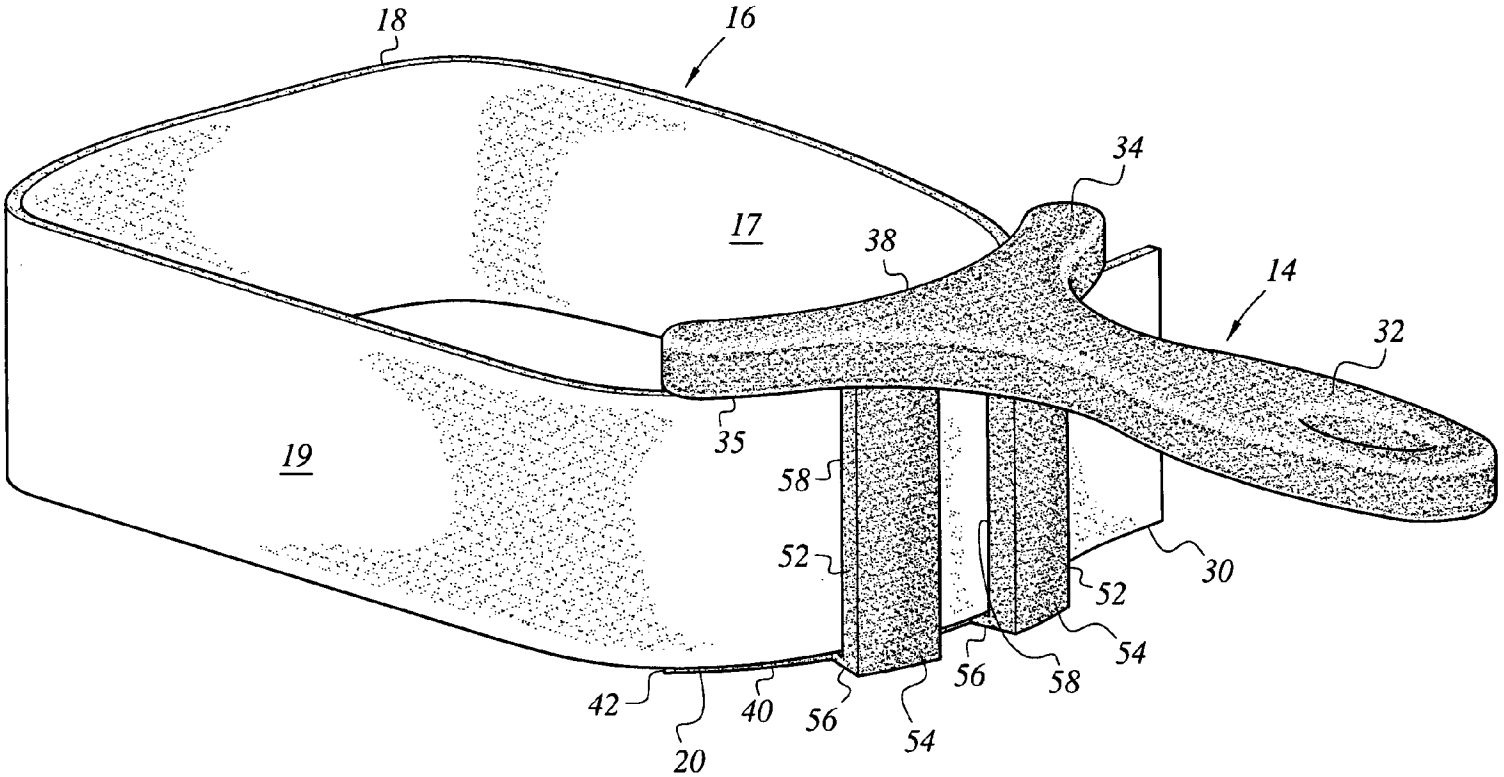
FIG. 7 is a rear upper perspective view of the assembled hoop guard of the present invention showing the buckle end portion of the strap inserted in the buckle of the handle portion ready for use.

Referring to FIGS. 6 and 7, there is shown a side elevation view of the hoop guard strap 16 as extended flat, and a rear perspective view of the assembled hoop guard 12, respectively. The assembled hoop guard has the attachment end portion 20 of hoop guard strap 16 mounted on strap support wall 36 by means of mushroom connector receivers 24 being mounted over mushroom connectors 46 (see FIG. 2) extending from the strap support inner side 44 of strap support wall 36. The strap 16 is then pulled such as to move connector stems 48 into stem receivers 28 securing connector heads 46 over the strap inner surface 17. The strap 16 is formed into a the desired shape and the buckle end 30 inserted the desired distance into strap buckle end receivers 52 where it is held by friction. The strap 16 may be formed into any desired generally circular shape, but is preferably shaped so as to conform with the shape of the hoop I. The buckle end 30 will separate from the handle portion upon pulling, thereby avoiding any choking hazard.

The material of the hoop guard strap is preferably of a flexible plastic material, but may be constructed of other suitable materials such as rubber, leather, or sheet metal. The material of the hoop guard handle is preferably made of relatively stiff, molded plastic, but may be constructed of other suitable materials. Other types of connectors may be employed for mounting the hoop guard strap to the strap support wall such as flat head screws as desired. The connectors may be in different patterns and numbers as desired and placed at any desired location along the strap support wall.

The hoop guard strap and supporting wall may be of any desired width so as to be effective and the hoop guard easily used and stored, the preferred width being about 2½ inches.

A range of hoop guard straps, of differing lengths may be provided for use with differing sized hoops.

It is to be understood that the present invention is not limited to the embodiment described above, but encompasses any and all embodiments within the scope of the following claims.

I claim:

1. A hand operated overspray guard comprising:

a handle portion having a grip;

a guard strap having opposing ends and being supported on edge relative to said handle portion;

said guard strap being connected at said opposing ends to said handle portion so as to form a generally circular overspray guard;

said handle portion having a grip portion and a strap support portion extending inward from said grip portion, said strap support portion having a plurality of mushroom connectors, said guard strap having an attachment end portion and a buckle end portion and supported generally vertically on edge by said handle portion so as to form a generally circular, overspray guard, and said strap attachment end portion defining a plurality of interfitting mushroom connector receivers for mounting said guard strap to said support portion;

whereby, upon said overspray guard being placed on a surface, said surface is sprayed with a coating within said generally circular overspray guard, and adjacent surfaces and elements are masked from contact with any overspray.

2. The overspray guard of claim 1, said strap support portion having a buckle for adjustably receiving said buckle end portion of said strap.

3. An embroidery sewing machine hoop guard, comprising:

a handle portion having a grip;

a guard strap having an attachment end portion and a buckle end portion and supported generally vertically on edge by said handle portion so as to form a generally circular, overspray guard;

said handle portion having a grip portion and a strap support portion extending inward from said grip portion;

said strap support portion having a plurality of mushroom connectors and said strap attachment end portion defining a plurality of interfitting mushroom connector receivers for mounting said guard strap to said handle portion;

said strap support portion having a buckle for adjustably receiving said buckle end portion of said strap; and said generally circular overspray guard being of such dimensions as to fit within a hoop of an embroidering machine;

whereby clothing material mounted and stretched on said hoop may be sprayed with adhesive within said overspray guard while said guard prevents adhesive overspray from contacting said hoop.

4. The hoop guard of claim 3, wherein said strap support portion has a vertical support wall depending therefrom having an inner side and an outer side, said plurality of mushroom connectors extending inward from said inner side, said guard strap having a corresponding plurality of mushroom connector receivers defined by said strap attachment end portion for mounting said strap to said handle portion on said mushroom connectors.

5. The hoop guard of claim 4, said strap support portion depending support wall having upper and lower horizontal edges and opposed vertical ends defining an inner side bearing said plurality of mushroom connectors for connection of said guard strap attachment end portion.

6. The hoop guard of claim 5, wherein said mushroom connectors are three in number forming a triangle, two of which are vertically spaced along said strap support wall.

7. The hoop guard of claim 5, wherein said strap support wall is concave in shape between said opposed vertical ends.

8. The hoop guard of claim 7, wherein said strap support wall has a convex outer side generally conforming with said concave strap support wall and said buckle is mounted on said convex outer side thereof.

9. The hoop guard of claim 8, wherein said buckle is formed by two laterally spaced, vertically oriented strap buckle end portion receivers.

10. The hoop guard of claim 9, wherein said strap support portion has an upper surface and an underside extending rearward of said outer side of said strap support wall, and said strap buckle end portion receivers are buckle uprights having lower spacers, spacing said buckle uprights from said outer side of said strap support wall at said lower edge thereof and extending upward to said strap support portion underside, defining spaced strap receiving slots for snugly receiving said buckle end portion of said guard strap.

11. The hoop guard of claim 10, wherein said strap receiving buckle uprights are equally spaced from opposite sides of said grip portion of said handle portion.

12. The hoop guard of claim 11, wherein said grip portion defines a hanging opening proximate its outer end.

13. An embroidery sewing machine hoop guard, comprising:

a handle portion having a grip;

a guard strap having an attachment end portion and a buckle end portion and supported generally vertically on edge by said handle portion so as to form a generally circular, overspray guard;

said handle portion having a grip portion and a strap support portion extending inward from said grip portion;

said strap support portion having a plurality of mushroom connectors and said strap attachment end portion defining a plurality of interfitting mushroom connector receivers for mounting said guard strap to said handle portion;

said strap support portion having a buckle for adjustably receiving said buckle end portion of said strap;

said generally circular overspray guard being of such dimensions as to fit within a hoop of an embroidering machine;

said strap support portion having a vertical support wall depending therefrom having an inner side and an outer side, said plurality of mushroom connectors extending inward from said inner side;

said guard strap having a corresponding plurality of mushroom connector receivers defined by said strap attachment end portion for mounting said strap to said handle portion on said mushroom connectors;

said strap support portion depending support wall having upper and lower horizontal edges and opposed vertical ends defining an inner side bearing said plurality of mushroom connectors for connection of said guard strap attachment end portion;

said strap support wall being concave in shape between said opposed vertical ends; and said strap support wall having a convex outer side generally conforming with said concave strap support wall and said buckle is mounted on said convex outer side thereof;

whereby clothing material mounted and stretched on said hoop is sprayed with adhesive within said overspray guard while said guard prevents adhesive overspray from contacting said hoop.

14. The hoop guard of claim 13, wherein said mushroom connectors are three in number forming a triangle, two of which are vertically spaced along said strap support wall.

15. The hoop guard of claim 13, wherein said buckle is formed by two laterally spaced, vertically oriented strap buckle end portion receivers.

16. The hoop guard of claim 15, wherein said strap support portion has an upper surface and an underside extending rearward of said outer side of said strap support wall, and said strap buckle end portion receivers are buckle uprights having lower spacers, spacing said buckle uprights from said outer side of said strap support wall at said lower edge thereof and extending upward to said strap support portion underside, defining spaced strap receiving slots for snugly receiving said buckle end portion of said guard strap.

17. The hoop guard of claim 16, wherein said strap receiving buckle uprights are equally spaced from opposite sides of said grip portion of said handle portion.

18. The hoop guard of claim 17, wherein said grip portion defines a hanging opening proximate its outer end.

19. The hoop guard of claim 18, wherein said mushroom connectors are three in number forming a triangle, two of which are vertically spaced along said strap support wall.

* * * * *